US005582340A

United States Patent [19]

Eriksson

[11] Patent Number: 5,582,340

[45] Date of Patent: Dec. 10, 1996

[54] DRIVE MECHANISM IN A STAPLER

[75] Inventor: Stig Eriksson, Hestra, Sweden

[73] Assignee: Isaberg AB, Hestra, Sweden

[21] Appl. No.: 313,159

[22] PCT Filed: Feb. 26, 1993

[86] PCT No.: PCT/SE93/00164

§ 371 Date: Oct. 6, 1994

§ 102(e) Date: Oct. 6, 1994

[87] PCT Pub. No.: WO93/19898

PCT Pub. Date: Oct. 14, 1993

[30] Foreign Application Priority Data

Apr. 7, 1992 [SE] Sweden ..... 9201094

[51] Int. Cl.[6] ..... B25C 1/06

[52] U.S. Cl. ..... 227/129; 227/131; 227/156

[58] Field of Search ..... 227/110, 111, 227/129, 131, 155, 156; 173/205

[56] References Cited

U.S. PATENT DOCUMENTS 3,982,678 9/1976 Olson ..... 227/131

4,834,278 5/1989 Lin ..... 227/131

FOREIGN PATENT DOCUMENTS 0364122 4/1990 European Pat. Off. .

21349 10/1902 United Kingdom ..... 227/128

577079 5/1946 United Kingdom ..... 227/129

*Primary Examiner*—Rinaldi I. Rada

*Assistant Examiner*—Allan M. Schrock

*Attorney, Agent, or Firm*—Shapiro and Shapiro

[57] ABSTRACT

A stapler for driving staples (5) into an object (6) has a frame (1), a magazine (2) arranged in the frame and containing staples (5), and a drive element (3) adapted to push staples (5) out of the magazine (2) and drive them into the object (6) and, to this end, be reciprocated by means of a drive mechanism. The drive mechanism consists of a drive cylinder (19) rotatably mounted in the frame (1) and having an endless groove (23) in its circumferential surface. The groove (23) extends substantially helically from a starting point to a turning point axially spaced therefrom, and thence substantially helically back to the starting point. The groove (23) accommodates a groove follower (24) connected to the drive element (3) in order, upon rotation of the drive cylinder (19), to reciprocate the drive element (3).

3 Claims, 3 Drawing Sheets

DRIVE MECHANISM IN A STAPLER

BACKGROUND OF THE INVENTION

The present invention relates to a drive mechanism in a stapler for driving staples into an object, such as a bundle of paper sheets, said stapler having a frame, a magazine arranged in the frame and containing staples, and a drive element adapted to push staples out of the magazine and drive them into the object and, to this end, be reciprocated by means of the drive mechanism.

In a prior-art stapler of this type, the drive mechanism consists of a wheel driven by an electric motor via a transmission unit, and a lever supporting the drive element at one end. The wheel has an eccentric pin engaging in a groove at the other end of the lever in order, when the wheel is rotated, to pivot the lever back and forth so as to reciprocate the drive element. This drive mechanism is quite bulky and difficult to mount. Moreover, it can only be used for driving a single reciprocative element (the drive element). In the known stapler, which is intended for U-shaped staples, there is thus provided another drive mechanism for reciprocating an operating member actuating a clinching mechanism, i.e. a mechanism bending the staple legs in such a manner that the staples after completed bending (clinching) have a uniform thickness throughout their entire length.

SUMMARY OF THE INVENTION

An object of the present invention is to overcome these drawbacks and provide a simple drive mechanism which requires less space, is easy to mount and which can also be used for reciprocative both the drive element and another reciprocative element, such as an operating member for operating a clinching mechanism.

This object is achieved by means of a drive mechanism which is of the type stated in the introduction to the specification and which is characterised in that it consists of a drive cylinder rotatably mounted in the frame and having in its circumferential surface an endless groove extending substantially helically from a starting point to a turning point axially spaced therefrom, and thence substantially helically back to the starting point, said groove accommodating a groove follower connected to the drive element in order, upon rotation of the drive cylinder, to reciprocate the drive element.

In a preferred embodiment, the groove accommodates a second groove follower connected to a second reciprocative element, such as a reciprocative operating member for operating a clinching mechanism, in order, upon rotation of the drive cylinder, to bring about a reciprocating motion of said second element that is coordinated with the reciprocating motion of the drive element.

The groove extends one or several turns around the drive cylinder.

BRIEF DESCRIPTION OF THE DRAWINGS

The invention will now be described in more detail with reference to the accompanying drawings, in which.

DESCRIPTION OF THE PREFERRED EMBODIMENT

Figure 1:
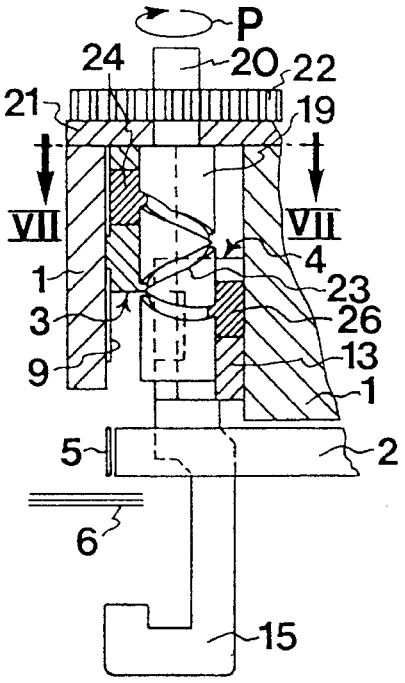
FIG. 1 is a sectional view showing a portion of a stapler equipped with a drive mechanism according to the invention, the drive mechanism being shown in a first position.

The stapler partially shown in FIG. 1 has a fixed frame 1, a magazine 2 arranged therein, a drive element 3 and an operating member 4 for operating a clinching mechanism (not shown). The clinching mechanism is not part of the invention and therefore will not be described in more detail here.

The magazine 2 houses U-shaped staples 5 arranged close to each other and forming a horizontal row of staples in the magazine. The drive element 3 is vertically displaceable for pushing the foremost staple 5 in the row of staples out of the magazine 2 to drive its legs through a bundle 6 of paper sheets placed in the stapler. The operating member 4 is vertically displaceable to coordinate the operation of the clinching mechanism with the motion of the drive element 3.

The drive element 3 and the operating member 4 are driven by a drive mechanism according to the invention, which will be described in more detail hereinbelow.

The drive element 3 consists of a block 7 of plastics material which is slidably displaceable in a vertical groove 8 in the frame 1, and a driver 9 in the form of a sheet-metal plate fixed on the block 7 by means of a lug 10 formed thereon and extending into a mating hole 11 in the sheet-metal plate. The block 7 has on its side opposite to the driver 9 a vertical groove 12 of semi-circular cross-section.

Figure 7:
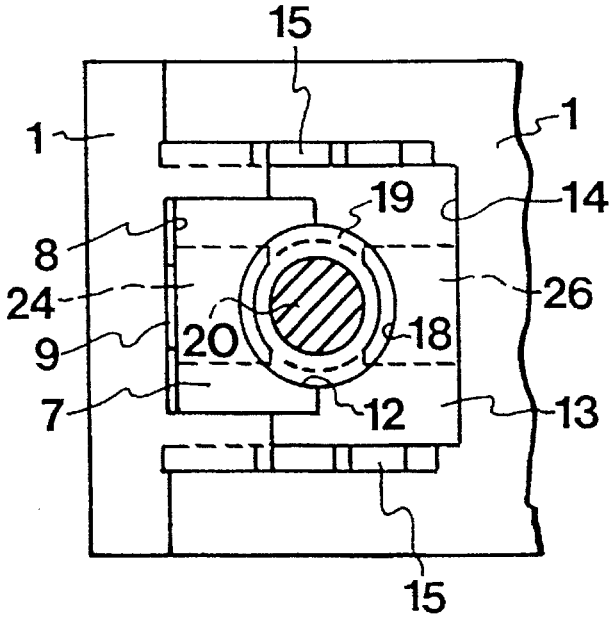
FIG. 7 is an enlarged sectional view taken along the line VII—VII in FIG. 1.

The operating member 4 consists of a body 13 of plastics material which is slidably displaceable in a vertical groove 14 in the frame 1 and has a substantially U-shaped cross-section, and two operating arms 15 in the form of sheet-metal plates, each fixed on one leg of the U-shaped body by means of a lug 16 formed on the respective U-leg and extending into a mating recess 17 in the operating arm 15. In its web portion, the body 13 has a vertical groove 18 of semi-circular cross-section. The web portion of the body 13 engages the side of the block 7 in which the groove 12 is formed, such that the groove 12, together with the groove 18 formed in the web portion, defines a guide channel 12, 18 having circular cross-section. The legs of the body 13 then engage two opposing sides of the block 7 (see FIG. 7).

The drive mechanism consists of a drive cylinder 19 having a vertical axis. The drive cylinder 19 has an upper journal 20 which extends through a plate 21 fixed on the frame 1, and is rotatably mounted in this plate. The journal 20 is non-rotatably connected at its free end to a gear wheel 22 which is rotatable in the direction of the arrow P by means of an electric motor (not shown) via a transmission unit (not shown).

The drive cylinder 19 is also rotatably mounted in the guide channel defined by the groove 12 in the block 7 of the drive element 3 and the groove 18 in the body 13 of the operating member 4. The diameter of this guide channel is substantially equal to the diameter of the drive cylinder 19.

The drive cylinder 19 has an endless groove 23 in its circumferential surface. The groove 23 extends substantially helically from an upper starting point P1 to a lower turning point P2 spaced axially therefrom, and thence substantially helically back to the upper starting point P1, which may also be regarded as an upper turning point. The distance between the two turning points P1 and P2 is, along the groove 23, 1.5 turns. The groove 23 thus extends three turns around the drive cylinder 19. The groove 23 has a lower groove portion which has a zero pitch and in which the lower turning point P2 is located. This groove portion has an extent of about 120°.

Figure 8:
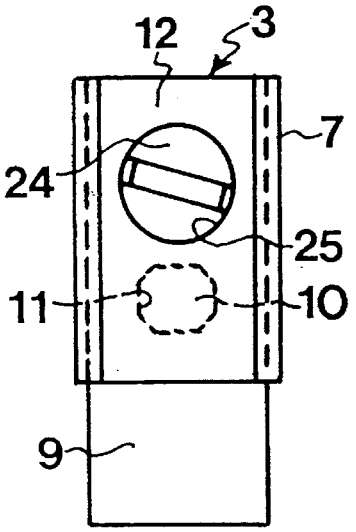
FIG. 8 is a side view showing a drive element which can be reciprocated by means of the drive mechanism.

A groove follower 24 of plastics material, which consists of a circular disc and, integrally formed therewith, a pin of elongate cross-sectional shape, is connected to the drive element 3 (see FIG. 8). The disc of the groove follower 24 is rotatably arranged in a circular recess 25 provided in the bottom of the groove 12 in the block 7, the pin of the groove follower 24 extending into the endless groove 23 of the drive cylinder 19.

Figure 9:
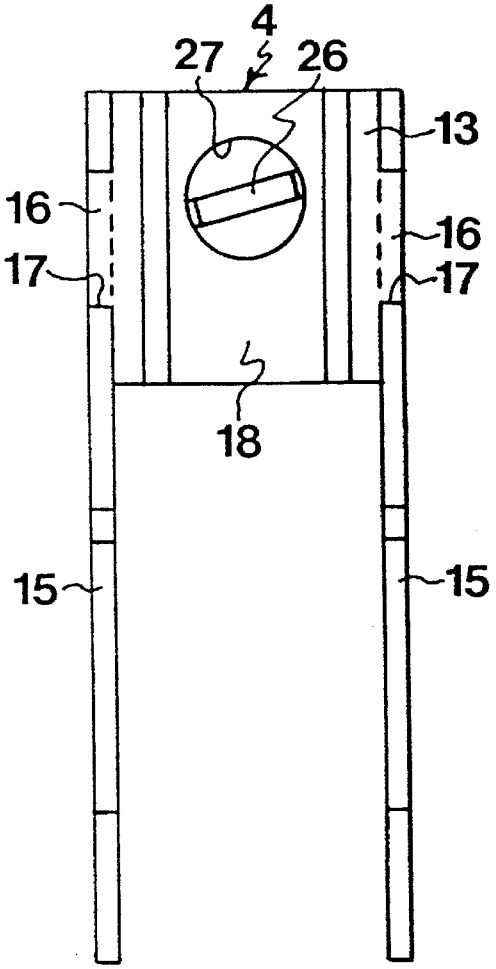
FIG. 9 is a side view showing an operating member which can be reciprocated by means of the drive mechanism.
Figure 10:
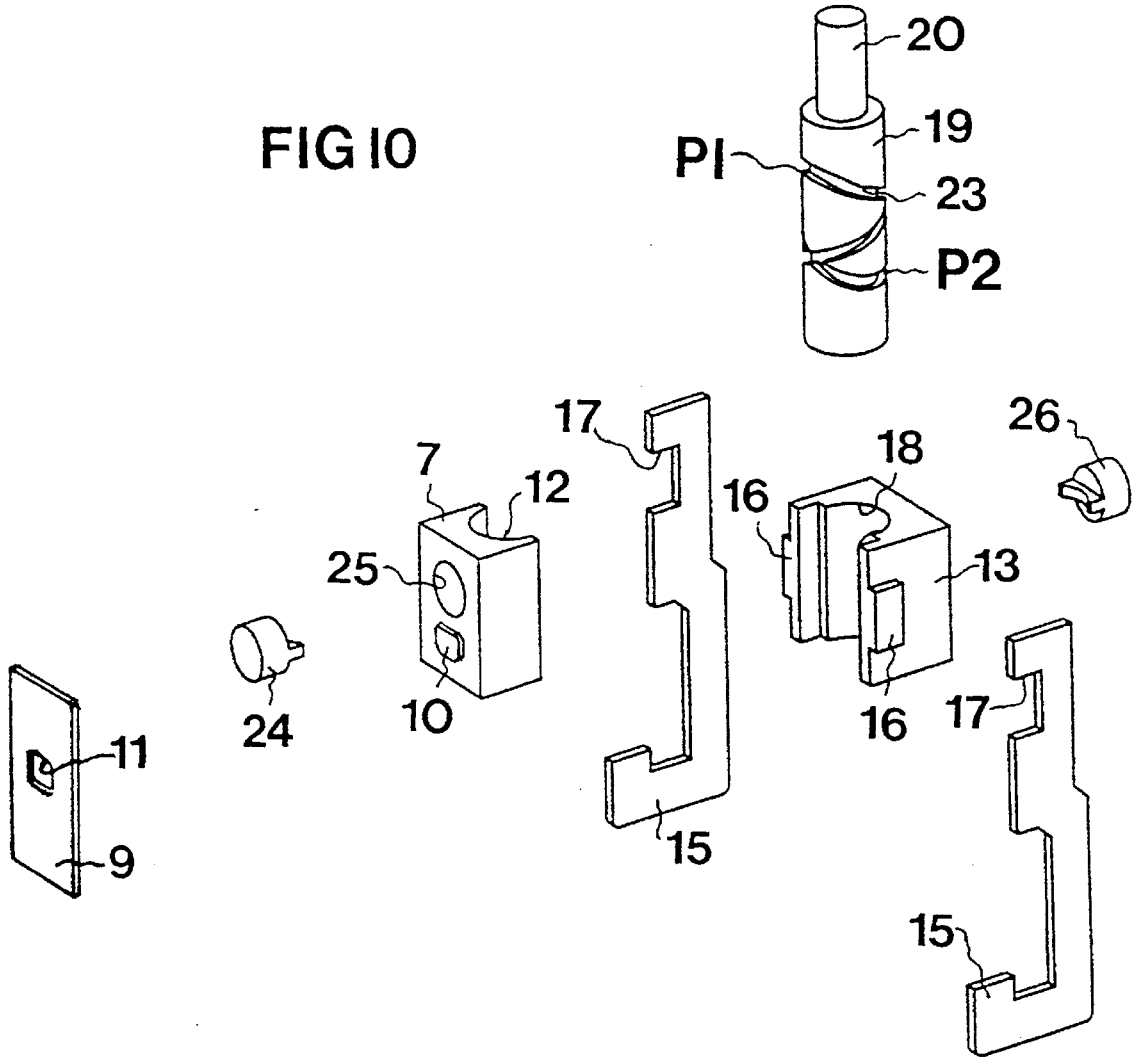
FIG. 10 is an exploded view showing a drive cylinder constituting the drive mechanism, as well as the drive element and the operating member.

A groove follower 26 of plastics material, which is similar to the groove follower 24, is connected to the operating member 4 (see FIG. 9). The disc of the groove follower 26 is rotatably arranged in a circular recess 27 provided in the bottom of the groove 18 in the body 13, the pin of the groove follower 26 extending into the endless groove 23 of the drive cylinder 19.

In the illustrated embodiment, the two groove followers 24 and 26 are located in a diametrically opposed relationship. In the starting position (FIG. 1), the pin of the groove follower 24 is located at the upper turning point P1 of the groove 23, while the groove follower 26 is located at its lower turning point P2.

When a bundle 6 of paper sheets is placed in the stapler, which is done when the different components are in the starting position shown in FIG. 1, a microswitch is actuated to start the electric motor which via the transmission unit rotates the gear wheel 22 and hence the drive cylinder 19 in the direction of the arrow P.

Figure 2:
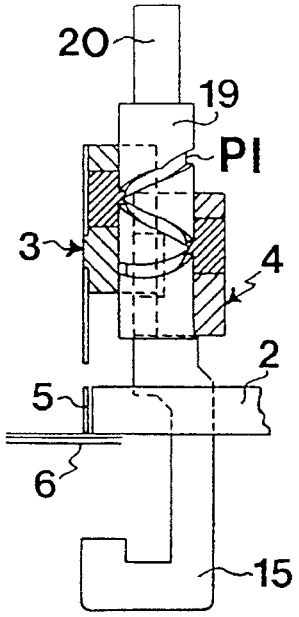
FIG. 2 is similar to FIG. 1 but shows the drive mechanism in a second position rotated approximately 180° with respect to FIG. 1.

When the drive cylinder 19 is rotated about 180° from the starting position shown in FIG. 1 to the position shown in FIG. 2, the drive element 3 is displaced a certain distance downwards, while the operating member 4 is displaced a certain distance upwards. During this displacement, the arms 15 of the operating member 4 release a block (not shown) included in the clinching mechanism, this block being moved upwards by a spring leaf (not shown) so as to urge the bundle 6 of paper sheets from below into abutment against the magazine 2 (FIG. 2). The block is maintained in this position during the stapling operation.

Figure 3:
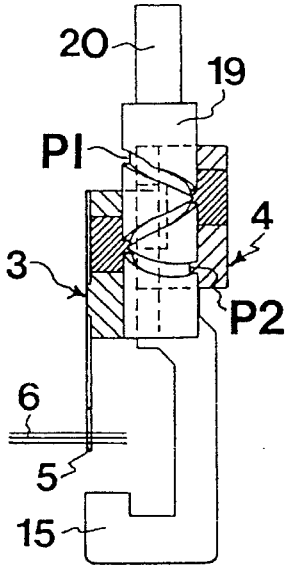
FIG. 3 is similar to FIG. 1 but shows the drive mechanism in a third position rotated approximately 180° with respect to FIG. 2.
Figure 4:
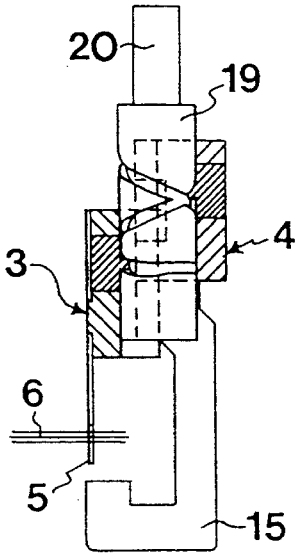
FIG. 4 is similar to FIG. 1 but shows the drive mechanism in a fourth position rotated approximately 45° with respect to FIG. 3.
Figure 5:
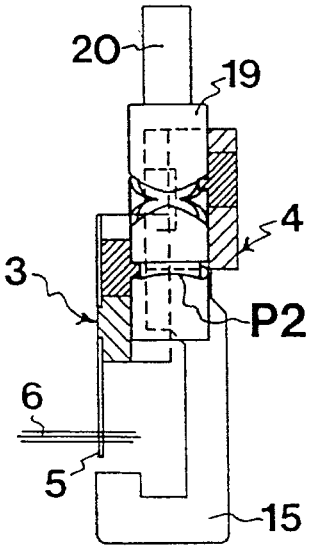
FIG. 5 is similar to FIG. 1 but shows the drive mechanism in a fifth position rotated approximately 45° with respect to FIG. 4.

Upon continued rotation of the drive cylinder 19, the drive element 3 is moved further downwards, such that its driver 9 reaches the foremost staple 5 in order to drive its legs through the paper bundle 6. The free ends of the staple legs then each engage a pivotal anvil member (not shown) which is part of the clinching mechanism and which at this stage of the stapling operation is maintained fixed. FIG. 3 shows the position in which the ends of the staple legs have just reached the anvil members. During the rotation of the drive cylinder 19 from the position shown in FIG. 3 to the position shown in FIG. 5, the drive element 3 continues to drive the legs of the staple 5 into the bundle of paper sheets, at the same time as the fixed anvil members pre-bend the staple ends inwards. During the rotation of the drive cylinder 19 from the position shown in FIG. 5 to the position shown in FIG. 6, the drive element 3 completes the driving-in of the staple 5 by the pin of its groove follower 24 reaching the lower groove portion of the groove 23, whereby the drive element reaches its lower position of displacement. During the rotation of the drive cylinder 19 from the position shown in FIG. 5 to the position shown in FIG. 6, the arms 15 of the operating member 4 reach the anvil members in order, during their upward displacement, to pivot the anvil members, so that these bring about clinching of the staple legs. During clinching, the drive element 3 is maintained in its lower position, since its groove follower pin is located in the lower portion of the groove 23, this portion having a zero pitch.

Figure 6:
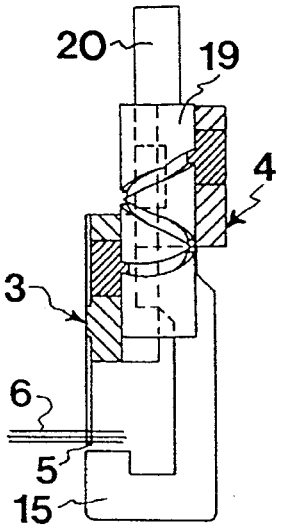
FIG. 6 is similar to FIG. 1 but shows the drive mechanism in a sixth position rotated approximately 90° with respect to FIG. 5.

In the position shown in FIG. 6, the drive cylinder 19 has been rotated 1.5 revolutions, the groove follower pin of the drive element 3 being located at the lower turning point P2 of the groove 23, while the groove follower pin of the operating member 4 is located at the upper turning point P1 of the groove 23. Clinching is then completed.

During the continued rotation of the drive cylinder 19 1.5 revolutions, the drive element 3 and the operating member 4 are returned to their starting positions (FIG. 1). During the downward displacement of the operating member 4, its legs 15 will swing the anvil members back to their starting position and move the block of the clinching mechanism down to its starting position, against the action of the spring leaf. When the operating member 4 reaches its lower position (FIG. 1), it acts on a microswitch stopping the motor.

I claim:

1. A stapler comprising a drive mechanism, a frame, a magazine disposed in the frame for containing staples, and a drive element that is reciprocated by the drive mechanism to push staples out of the magazine and into an object, the drive mechanism including:

a drive cylinder that is rotatably mounted in the frame, the drive cylinder including a circumferential surface having an endless groove with a starting point and a turning point that is axially spaced from the starting point, the endless groove having a first portion extending substantially helically from the starting point to the turning point and a second portion extending substantially helically from the turning point back to the starting point, the groove accommodating a groove follower of the drive element that follows the groove and causes the drive element to reciprocate upon rotation of the drive cylinder.

2. A stapler as claimed in claim 1, wherein the groove accommodates a second groove follower of a reciprocative second element that follows the groove and causes the reciprocative second element to reciprocate in coordination with the drive element upon rotation of the drive cylinder.

3. A stapler as claimed in claim 1, wherein the groove extends several turns around the drive cylinder.

* * * * *